United States Patent [19]

Corden et al.

[11] Patent Number: 4,738,042

[45] Date of Patent: Apr. 19, 1988

[54] INTEGRAL MOVING MESSAGE DEVICE FOR MERCHANDISING DISPLAY CASE

[75] Inventors: Paul H. Corden; Robert A. Johnson, both of Spartanburg; Joseph G. Correia, Lyman; Dan G. Hopkins, Inman, all of S.C.

[73] Assignee: Specialty Equipment Co., Inc., Greenville, S.C.

[21] Appl. No.: 920,505

[22] Filed: Oct. 17, 1986

[51] Int. Cl.[4] ..... G09F 11/12

[52] U.S. Cl. ..... 40/472; 40/584; 40/524

[58] Field of Search ..... 40/472, 584, 524, 312

[56] References Cited

U.S. PATENT DOCUMENTS

| | | | |
|---|---|---|---|
| D. 268,071 | 3/1983 | James et al. | D6/187 |
| 2,799,954 | 7/1957 | Donnely | 40/472 |
| 3,395,472 | 8/1968 | Look | 40/472 |
| 3,552,049 | 1/1971 | Foote | 40/472 |
| 3,600,834 | 8/1971 | Stamer | 40/472 |
| 4,110,922 | 9/1978 | Leeman-Dittmann | 40/472 |
| 4,274,267 | 6/1981 | James et al. | 62/252 |
| 4,454,670 | 6/1984 | Bachman et al. | 40/584 |

OTHER PUBLICATIONS

"The Moving Message Electronic Display" Brochure—Owner's Operating Manual by Dynasty Classics, 116 So. Catalina Ave., Redondo Beach, Calif. 90277, (pp. 1-6 and 34), for Models 1150T and 1151.

*Primary Examiner*—Gene Mancene
*Assistant Examiner*—Wenceslao J. Contreras
*Attorney, Agent, or Firm*—Dority & Manning

[57] ABSTRACT

A commerical merchandising unit for displaying products offered for sale is integrally provided with a device displaying moving merchandising message indicia. Fixed merchandising message indicia may further be integrally combined in the general vicinity of the moving indicia. The integral appearance of either the moving indicia, or the fixed and moving indicia, combined with a merchandising unit, such as a refrigerated display case, significantly enhances the merchandising affect of the merchandising indicia.

13 Claims, 3 Drawing Sheets

INTEGRAL MOVING MESSAGE DEVICE FOR MERCHANDISING DISPLAY CASE

BACKGROUND OF THE INVENTION

This invention concerns in general the association of moving messages with product merchandising, and in particular the integral incorporation of a moving message device with a merchandising display unit such as a cooler or similar item, for providing moving merchandising messages directed to products displayed by such merchandising unit.

A widespread and well known merchandising technique is to display an advertising sign in the vicinity of goods offered for sale. Ideally, though sometimes overlooked, an advertising sign should be attractively displayed with the referenced products in such fashion that the potential customer immediately recognizes the intended relationship without any confusion. Depending on the type of product and the way in which it must be or is customarily displayed for sale, there may be great difficulty in positioning an advertising sign in desired proximity with the related products. Such difficulty may be compounded if there is a need or desire to frequently alter the advertising.

Advertising, of course, which includes numerous psychological concerns related to various aspects of attracting and influencing potential customers. For example, the attractiveness of the advertising itself can be related to both the aesthetic appearance of the ad and the wording of the ad itself. Products themselves also carry name brand and promotional indicia entirely separate from merchandising indicia which may be provided by a retailer.

In some instances, it is desireable to provide merchandising indicia which identifies a brand name or the like for a product, and also to separately provide slogan or promotional merchandising messages directed to the product or products. For example, drink manufacturers often promote special incentives or programs intended to boost sales at retail outlets such as grocery stores or at food service establishments, or may establish promotional packages to be used directly in the store by the retailer. Frequently, a retailer may decide or be encouraged to build a display of the highlighted soft drink products, with special posters and the like associated with the particular promotional campaign mounted on the top of such display or otherwise associated therewith. Obviously, distribution and handling of such posters and the like is inconvenient for both the drink manufacturers and retailers.

Also, customers must often move or step over and around promotional materials in order to retrieve the desired products. As such materials become dislocated by customer activity or usage wear and tear on the often paper or cardboard materials, the attractiveness of the advertising (and hence the effectiveness thereof) can become greatly diminished.

The general marketing problems discussed above are even compounded concerning certain products such as refrigerated products, where there are specific limitations on the manner in which the products may be displayed. Refrigerated cases are often relatively unattractive due to the necessity of performing their practical functions. Also, they can be rather large, and disposed in groups with no space inbetween, which can hinder the association of any type of merchandising indicia with products stored in the refrigerated cases. Furthermore, even greater inconvenience may be involved with temporary, changing special promotions indicia.

Placing a sign on top of a tall vertically-oriented cooler is generally more problematic than associating a sign with a lower, horizontally-oriented cooler. For example, using a fixed sign with printed subject matter such as brand name indicia thereon in combination with a horizontal merchandising cooler is known, as taught by U.S. Pat. No. 4,274,267 and U.S. design patent 268,071, both issued to James, et al. While such structure and design provide effective methods of identifying brand names and the like of particular products such as soft drinks routinely stored in a particular orientation in a refrigerated cooler, such patents are not particularly adapted for also providing changing information such as promotional campaigns, or special slogans regarding such products.

One device for providing readily changeable merchandising information is a moving message electronic display. Such display devices are programmable to permit selection of a message which then may be scrolled across the display thereof. A very neat appearance is maintained, and a lengthy message (for example, up to 1926 characters) can be provided in a greatly compressed width (for example, 15 characters). Furthermore, such units are available as self-contained devices which may be placed on flat surfaces such as tables or shelves, or variously mounted or even hung from a ceiling. Examples of such type of moving message electronic display devices are Models 1150T and 1151 electronic display devices distributed by Dynasty Classics of 116 South Catalina Avenue, Redondo Beach, Calif., 90277.

In general, such stand-alone electronic devices may be associated with goods to be sold in somewhat similar fashion as signs, posters or ceiling-hanging mobiles have been used heretofore. Thus, use of an electronic message display can involve the same drawbacks of placement and support which occur whenever one attempts to associate a sign or poster with a refrigerated sales case, display stack, or the like.

Furthermore, such electronic display has the additional disadvantage of requiring electric power. Ordinarily, a retailer would wish to have electric wires concealed for safety and potential lawsuit purposes. For at least partly such reason, even cardboard-type displays which having a moving part (such as a revolving element) are often battery operated. Of course, batteries for such promotional items also present the need for running long, experience and unsightly extension cords around the retailer's store.

SUMMARY OF THE PRESENT INVENTION

In general, the present invention recognizes and addresses the above-noted drawbacks of using moving message electronic displays for merchandising products.

Accordingly, it is one object of this invention to facilitate use of moving message displays with products to be sold, particularly products presented in a merchandising display case. Such object further includes the objective of enhancing the merchandising of such products by providing an appearance for such products and moving message display whereby same are integrally associated in the mind of the potential customer. Thus, no customer confusion is likely, and a changeable message with a neat marketing appearance is provided.

It is another more particular object of this invention to provide frame and housing structure particularly adapted for integrally associating an electronic moving message display device with a merchandising unit, for example such as an upright cooler.

It is a further object to provide such electronic moving message display-supporting structure optionally combined with more conventional fixed indicia, such that both the moving and fixed indicia appear integrally with commercial units, such as refrigerated cases which display products to which the merchandising messages are directed.

It is yet another feature of this invention to provide moving merchandising messages integrally disposed with a merchandising cabinet such as a refrigerated cabinet, which messages can be securely provided while yet being readily changeable by authorized individuals. In providing such a moving message capability in combination with a merchandising display unit, it is a further object of this invention to completely obviate the need for cardboard posters to be shipped and distributed among retail outlets for use with special promotional campaigns and the like, even though such items if desired may be used in addition to practicing the present invention.

Such objects and others of the present invention are obtained through practice of various features presently disclosed, differing combinations of which may form given embodiments in accordance with the present invention. One exemplary embodiment concerns a refrigerated container for merchandising refrigerated products contained therein, comprising a generally refrigerated receptacle, having a plurality of insulated walls integrally formed so as to define an interior space and an opening leading thereto; compartment areas defined within the interior space for supporting within the receptacle products to be refrigerated and merchandised; at least one door closure member mounted on the receptacle for being selectively positioned so as to alternately open and close the receptacle opening; and advertising means, mounted on the receptacle so as to appear generally flush and integral therewith, for prominently displaying advertising indicia making reference to products supported within the compartment areas, the advertising means including moving message display means for providing a merchandising message related to the products, which message is movable across the face of the display means; whereby a moving merchandising message is attractively and prominently displayed with an appearance integrally related to a refrigerated container holding products to which such moving message is directed.

Another exemplary embodiment concerns a refrigerated box for merchandising refrigerated products such as drinks identified with particular brand names, comprising a generally rectangular, upright refrigerated structure having insulated walls and an interior refrigerated compartment which is adapted for receipt and storage of units of the products, the refrigerated structure defining an opening on one side thereof through which said products may be retrieved; a door closure member mounted so as to be selectively opened and closed relative the opening to permit the products to be retrieved, the door member being transparent to permit viewing of the products prior to their retrieval; a generally horizontal and rectangular cavity defined by the refrigerated structure adjacent the one side thereof, and prominently located above the structure opening across the upper top of the refrigerated structure; indicia support means, received in the cavity, and including a multi-compartment generally planar frame member disposed substantially flush with the one side of the refrigerated structure; and separate fixed and movable advertising indicia respectively associated with different compartments of the frame member; whereby fixed and movable advertising indicia, directed to products which may be retrieved from within the refrigerated structure, are integrally associated with such refrigerated structure in an attractive manner which enhances the merchandising of the products therein.

Still another alternative embodiment of this invention is directed to combined and fixed and moving merchandising indicia for a merchandising display unit displaying products intended for sale, such unit having a cavity integral with the body thereof, proximate to an opening through which products may be retrieved therefrom, and occupying a prominent position on a side of the display unit which is primarily intended to be viewed by potential purchasers of the products displayed thereby, the indicia comprising: a housing adapted to be substantially matingly received within such display unit cavity; a facial frame secured to the housing, substantially situated co-planar with the side of such display unit to be viewed, and defining several compartments in such plane; a pair of at least partially transparent members, bearing fixed advertising indicia, received respectively in compartments of the facial frame, the fixed indicia thereof being disposed for reading by potential purchasers from the viewing side of such display unit; an electronic programmable display device, situated in a substantially prominent compartment of the facial frame, for displaying moving advertising indicia; and illumination means supported by the housing behind the fixed indicia members for backlighting same; whereby both fixed-type and moving message-type advertising indicia may be attractively displayed with an integral appearance relative a merchandising display unit and proximate to the products to which the messages of such indicia are directed, so as to thereby enhance the merchandising of such products.

One of ordinary skill in the art will recognize numerous variations and modifications to embodiments presently disclosed, including equivalent substitutions thereto and various reversal and interchange of elements thereof, all of which are intended to fall within the scope and spirit of the present invention.

BRIEF DESCRIPTION OF THE DRAWINGS

The structure and construction thereof for practicing the present invention will be hereinafter described, together with other features thereof. The present invention, including the best mode thereof, will be readily understood upon studying the following specification, including reference to the accompanying figures forming a part thereof, wherein.

Use of like reference characters throughout the present application is intended to indicate the same or analogous elements or features thereof.

DESCRIPTION OF A PREFERRED EMBODIMENT

Figure 1:
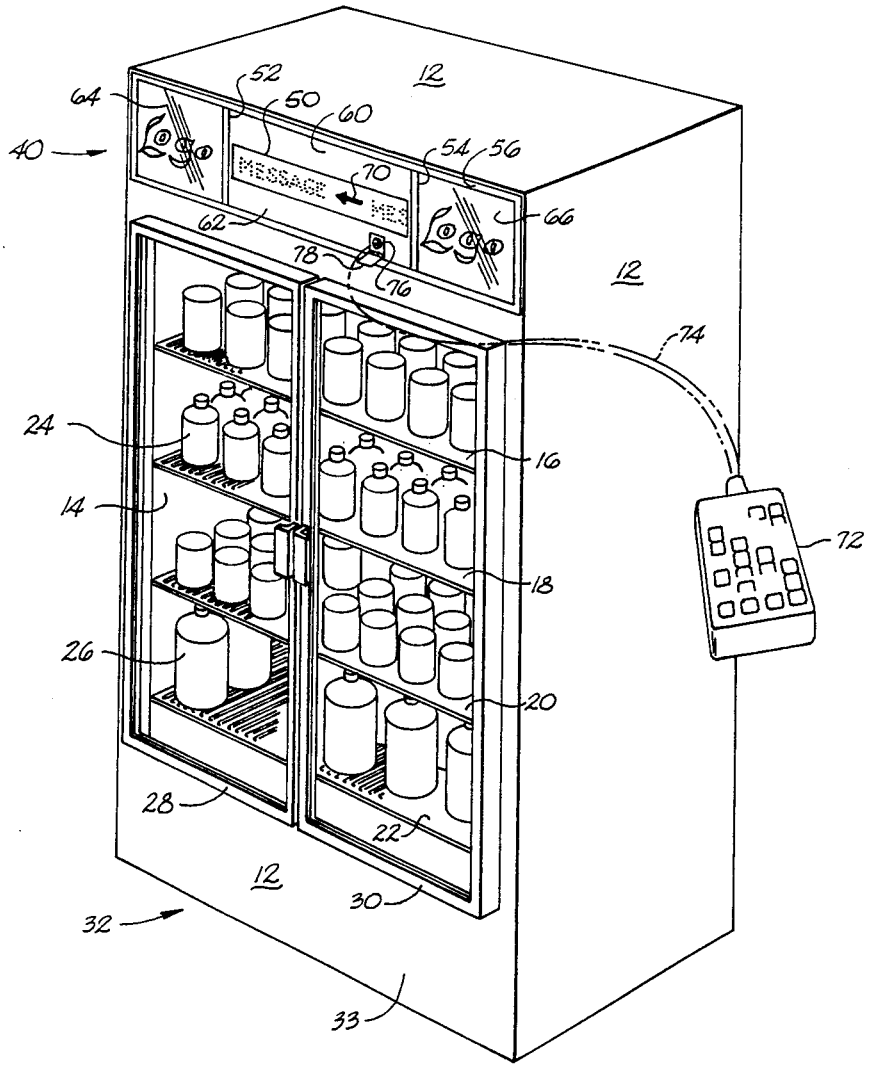
FIG. 1 is a perspective view of a merchandising unit (such as a refrigerated display case) in accordance with the present invention, including a combination of fixed and moving message indicia integrally incorporated therewith.

It should be understood that, in general, the present invention may be practiced with a variety of different types of commercial display units, including but not limited to open or enclosed units, and refrigerated or non-refrigerated units. For the present purpose of presenting a presently preferred exemplary embodiment, FIG. 1 illustrates a perspective view of a refrigerated unit or cooler 10. Cooler 10 may comprise a generally upright, rectangular refrigerated box intended for the commercial display and merchandising of refrigerated products, such as soft drinks or the like. Refrigerated unit 10 includes a number of insulated walls 12, several of which are seen in the view of FIG. 1 and others of which are understood. Such walls define a central or interior space 14. In this instance, such space is refrigerated for storage of refrigerated products, as understood by one of ordinary skill in the art. Provision by cooler 10 of such refrigeration is both well understood and does nto form particular features of this invention; thus, detailed disclosure thereof is not required.

Interior space 14 may be utilized in a number of different ways, but one typical way is to provide a plurality of compartment areas or shelves 16, 18, 20, and 22 throughout the interior space. Various products such as 24 and 26 may then be selectively and separately supported in various orientations on such shelves.

Typically, in the case of refrigerated display units, interior space 14 is covered by one or more movable door members. In the exemplary embodiment of FIG. 1, such door members include two doors 28 and 30, each pivotally mounted on hinges (not shown). Furthermore, such door members are typically transparent to permit prospective customers to view the contents of cooler 10 without having to open and expose the refrigerated interior space thereof. Sliding doors, opaque doors, translucent doors, or other door member variations may also be practiced. Of course, if cooler 10 more generally comprises a non-refrigerated type commercial display unit, then such doors may be omitted altogether.

Ordinarily, cooler 10 is designed with the intention that one side thereof (e.g. side 32) will be primarily viewed by potential purchasers of products 24 and 26 stored in the various compartment areas defined within interior space 14. Hence, a number of coolers 10, similar items or even dissimilar items may be arranged in a single line with their side walls adjoining, or in double lines with their back walls adjoining, as understood by those of ordinary skill in the art. Thus, while various brand name indicia and the like may be painted or otherwise illustrated on side and back walls of cooler 10, side 32 thereof is the primary focus of attention for both the retailer of the products stored therein and potential purchasers thereof.

It is relatively unlikely that merchandising or advertising indicia located near or on bottom panel 33 of side 32 close to a customer's feet will be effective in either attracting or influencing a customer. Also, it is obviously undesirable to cover the transparent portions of doors 28 and 30 with brand name or advertising indicia since that would obscure viewing of the products contained within interior space 14. Thus, the "headboard" or upper portion 40 of side 32 (i.e. above the opening therein for interior space 14 and approximately at eye level or just above for many potential customers) has been previously used for placement of fixed advertising indicia. In particular, fixed indicia mounted on transparent or translucent material have been mounted in such top space 40, and have been known to include light bulbs or the like mounted therebehind for backlighting such fixed indicia.

FIG. 1 illustrates an exemplary embodiment of the present invention, wherein the head space or top area 40 of a cooler 10 is particularly adapted so as to include moving message indicia in such manner as to form an integral impression with cooler 10, when viewing side 32 thereof. In particular, an electronic light display 50 is substantially horizontally disposed between vertical elements 52 and 54 of a frame member 56 received across the face of an opening or cavity (not shown) formed in top area 40 of cooler 10.

Figure 2:
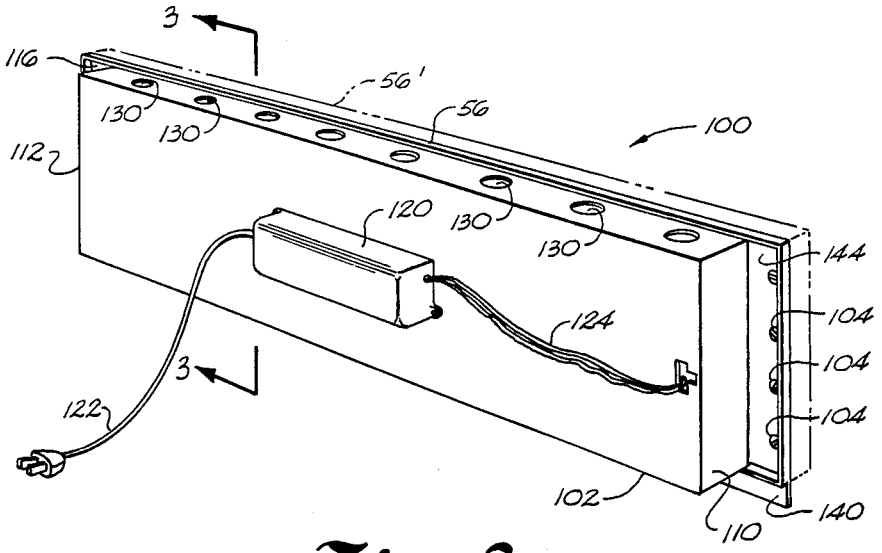
FIG. 2 is an enlarged rear perspective view of structure adapted to be supported by a merchandising display unit such as in FIG. 1, which structure supports on the front thereof the moving message and fixed indicia illustrated in exemplary fashion in FIG. 1.
Figure 3:
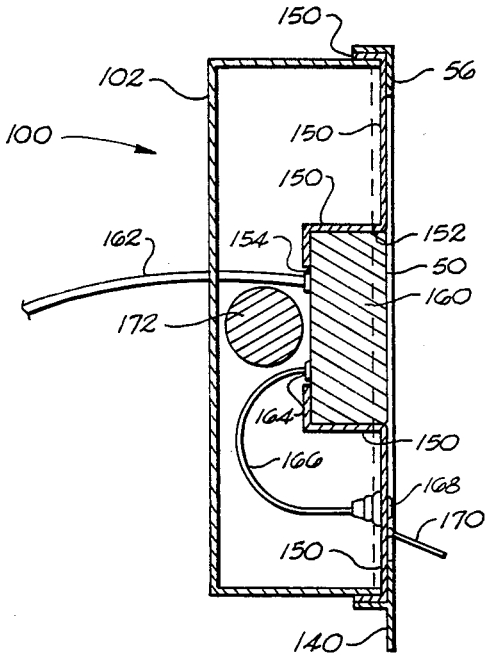
FIG. 3 is a cross-sectional view of the structure of FIG. 2 along the sectional line 3—3 indicated therein.
Figure 4:
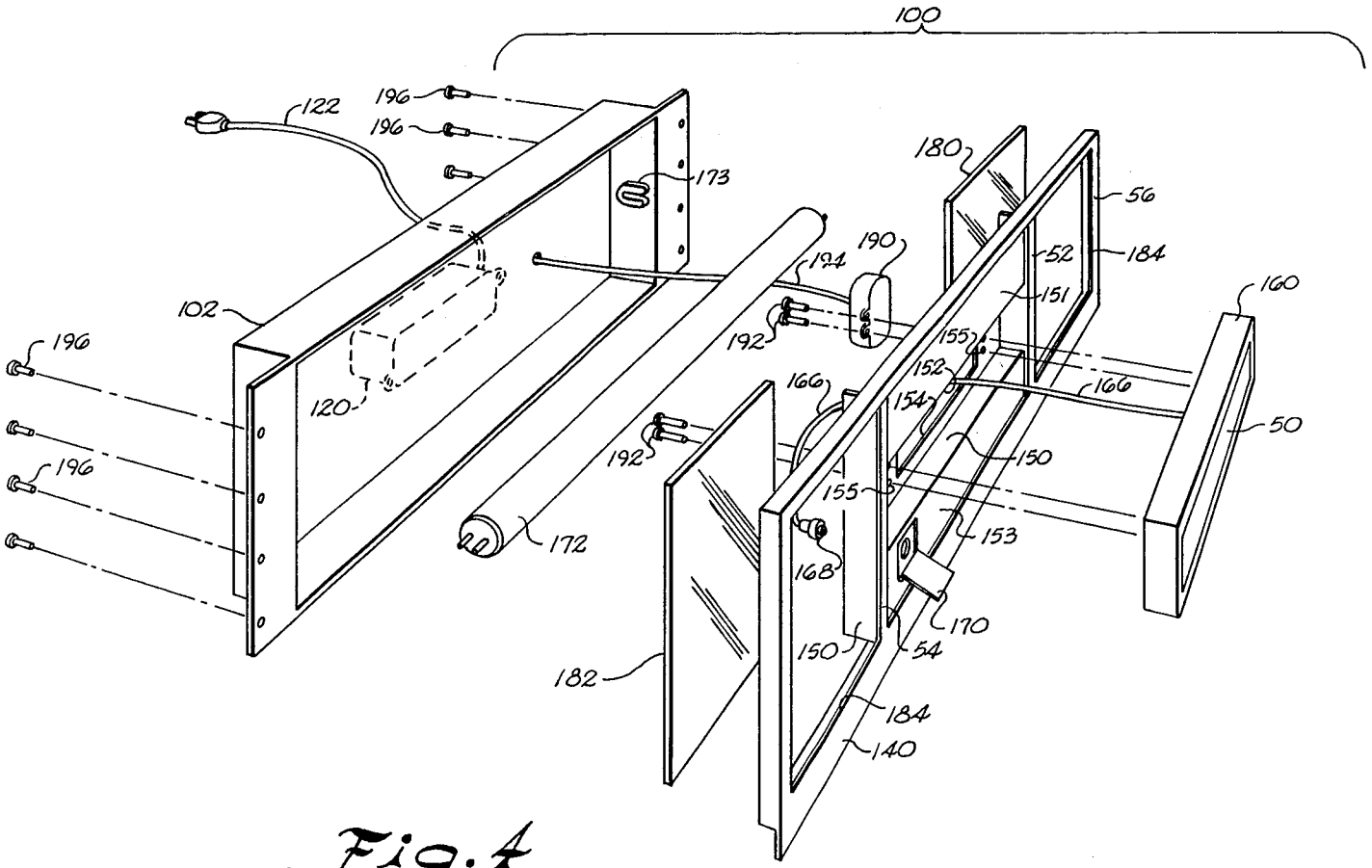
FIG. 4 is an exploded generally frontal perspective view of the structure of FIG. 2, including some internal details thereof not otherwise shown with the view afforded by FIG. 2.

FIGS. 2–4 and their related discussion disclose details of frame member 56 and other present features, while FIG. 1 illustrates the structure of the present invention ordinarily perceived by a potential customer. Frame 56 also supports similar-sized generally opaque members 60 and 62 disposed just above and below, respectively, display 50. Such opaque members serve to accentuate the lighted, moving display therebetween. Also mounted in frame 56, on either end of display 50 are disposed a pair of generally translucent members 64 and 66, bearing fixed indicia. Such fixed indicia may typically and preferably be directed to brand name identification of products refrigerated and displayed within cooler 10. Thus, frame member 56 in the exemplary embodiment of FIG. 1 supports a combination of translucent planar members having fixed merchandising messages and an electronic display device 50 having a moving and changeable merchandising message or messages.

As understood from the Summary portion of the specification, supra, electronic display 50 may provide a relatively longer message which effectively is scrolled across the front surface thereof, for example in the direction of arrow 70. Such display device may be a self-contained unit, such as the Dynasty Classics electronic display model, discussed above. Programming of such unit (i.e. loading messages therein to be flashed on its front surface) may be selectively accomplished with a detachable keyboard 72, as understood by one of ordinary skill in the art. From time to time, when it is desireable to replace or revise the message conveyed by display device 50, an input line 74 from keyboard 72 (illustrated in representative fashion) may be plugged into an input jack 76, for example mounted on one of the opaque members, such as 62. Then, the new or revised message can be input. A hinged cover 78 or equivalent structure may be used to selectively control access to such input jack 76, or just to improve the aesthetics of the arrangement.

As understood from the exemplary embodiment of FIG. 1 and its related discussion, frame member 56 and fixed and moving indicia associated therewith, as well as other structural and electronic elements in support thereof, may comprise an advertising means for cooler 10, capable of displaying both fixed and moving merchandising messages directed to products received within such cooler. It is not essential or required that fixed indicia be utilized. For example, one or both of translucent planar members 64 and 66 may be replaced with opaque or blacked-out members so as to further heighten the emphasis on moving message display 50. Alternatively, frame 56 may be re-configured for a merchandising display unit which is more or less wide relative display device 50 than the display unit illustrated in FIG. 1. In the instance of a less wide unit, vertical members 52 and 54 may for example comprise the end members of frame 56, and the fixed indicia portions thereof and related frame member portions may be omitted.

FIG. 2 illustrates more clearly the portion of the FIG. 1 embodiment which may generally comprise an advertising means 100, which is adapted to be matingly received within, the headboard or top area cavity of cooler 10. Essentially, frame member 56 generally surrounds the outer periphery of advertising means 100, and engages a housing 102 which may be variously secured, such as by bolts, rivets, welding and the like to such frame member. Housing member 102 is held in the exemplary embodiment of FIG. 2 to frame member 56 by metal screws 104.

Housing member 102 has indented side walls 110 and 112 which facilitate receipt and support of member 102 within the cooler 10 cavity. In such case, flange-like portions 114 and 116 of member 102 extend in cooperation with frame member 56 so as to engage an outer face portion of the top area cavity of cooler 10. Such configuration provides frame member 56 with the appearance of being seated substantially flush against the front surface 32 of cooler 10, which is desirable for achieving the overall integrated appearance of merchandising indicia and merchandising display unit, discussed above.

Of course, alternate configurations generally conforming with the spirit of the present invention are an included aspect thereof. For example, the top area cavity of cooler 10 may have deeper flange portions than that suggested by the depth of solid line frame member 56 illustrated in FIG. 2. The dotted line representation 56' of such figure illustrates a frame member with increased depth which could be used with such modified cavity of cooler 10 so as to still provide the desired integral appearance therewith.

In either case, or even in the case of other modification or variation thereto, it is generally intended that frame 56 support the fixed and moving merchandising indicia on a front or facial surface thereof (not seen in FIG. 2, but shown in FIG. 1). Meanwhile, housing member 102 provides support for and generally surrounds other features and aspects of this invention, including light means for backlighting fixed indicia partial translucent members. One exemplary light means comprises a fluorescent tube disposed horizontally and extending virtually the entire length of housing member 102. In such instance, a ballast 120 may be mounted on the outward or rear side of housing member 102, while the fluorescent tube is mounted on the inside of such housing member (further detail of which is illustrated in FIGS. 3 and 4, below). Power line 122 is intended to be generally representative of power which must be supplied to such ballast 120, while lead line 124 is representative of one of the necessary connections between ballast 120 and sockets for holding a fluorescent tube or equivalent lighting element.

Further details of the placement of elements and features within housing member 102 are illustrated by FIGS. 3 and 4, discussed below. FIG. 2 illustrates a number of optional heat-venting holes 130 which may be incorporated into housing member 102 for permitting heat to be ventilated from the light means within such housing and the electronic display device also included therein. The number, placement, and shape of such openings may vary depending on particular circumstances and needs, and in fact may be omitted altogether in some instances.

To further add to the integral appearance of moving message indicia (and fixed indicia when included) with a refrigerated unit, frame member 56 may include a horizontal flange 140 extending across the bottom face thereof (particularly whenever the solid line embodiment 56 of such a frame member is utilized). Alternatively, such flange 140 may assist in the securing of advertising means 100 to a cooler 10, by being disposed for capture under a mating lip or edge of cooler 10. The remainder of the advertising means 100 structure could then be snapped or press fit into place. Alternatively, various screw hole arrangements or the like may be used in place or in combination with a snap fit for retaining advertising means 100 within the top area cavity of cooler 10 provided for receipt of such means.

FIG. 3 illustrates a cross-sectional view of the exemplary embodiment of FIG. 2, as defined by the sectional line illustrated in such figure. The FIG. 3 cross-section is directed to the solid line embodiment of FIG. 2. The cooperation of frame member 56 with housing member 102 is illustrated. Furthermore, an additional element 150 is shown cooperating with frame member 56, particularly for the purpose of receiving and supporting electronic display device 160. Members 56 and 150 may be combined or engaged in a variety of ways, such as being welded together, or held together by attachment means (screws, bolts, rivets, etc.). Such internal support structure 150 defines an opening 152 on its front side which permits viewing of the display portion 50 of electronic display device 160, and defines a separate opening 154 on its backside which facilitates application of power to device 160 and programming thereof. In particular, an input power line 162 may pass through opening 154 after passing through other appropriate openings in the backside of housing member 102 (see FIG. 4).

Similarly, an input jack 164 may be mounted on the reverse side of display device 160 so as to permit programming thereof. While it is possible to provide an embodiment with input jack 164 remaining on such reverse side, it is preferred that an extension element 166 and remote input jack 168 be utilized so that no portion of the advertising means 100 need be disassembled for the purpose of reprogramming display device 160. Remote input jack 168 is generally analogous to input jack 76 illustrated by FIG. 1. Likewise, a cover 170 may be provided for selectively covering such jack. Remote jack 168 may be positioned in alternate locations from that illustrated without departing from the spirit of this invention.

As discussed with reference to FIG. 2, a horizontal, length-wise flange 140 may be provided to enhance the integral appearance of advertising means 100 and cooler 10. Likewise, a horizontal length-wise fluorescent tube 172 may be used to provide backlighting for a pair of translucent planar members, such as 64 and 66 of FIG. 1. The configuration of FIG. 3 in that regard is particularly advantageous in that a single fluorescent tube 172 can be used to provide backlighting for translucent or transparent members disposed anywhere along the horizontal length of frame member 56. The depth of housing member 102 is sufficient to enclose such fluorescent tube, internal support structure 150, and electronic display device 160. Of course, alternate configurations are included within the spirit of the present invention. One example of same may include the use of two incandescent bulbs, with one of each such bulbs being disposed behind a respective fixed indicia member for backlighting same.

FIG. 4 generally illustrates an exploded, frontal perspective view of an exemplary embodiment of the present invention. Generally moving from the front side of advertising means 100 (i.e. the side intended to be viewed by potential customers) to the backside thereof, frame member 56 includes two vertical members 52 and 54, which serve to define compartments in the face or plane formed by such frame member. Alternative compartment configurations may be practiced. Interior support structure 150 may integrally include two generally opaque members 151 and 153 (analogous to members 60 and 62, respectively, of FIG. 1) which are disposed in the facial plane defined by frame 56. In addition to the rear opening 154 defined by interior support structure 150, a plurality of mounting holes 155 may also be provided for securing electronic display device 160 to interior support structure 150.

As earlier discussed, electronic display device 160 may comprise an essentially stand-alone unit which is generally received and mounted as an integral package within advertising means 100, and particularly within opening 152 defined by interior support structure 150. While various elements and features of the present invention may comprise different materials, it is preferred that frame member 56, interior support structure 150, and housing member 102 be of generally sheet metal construction. In such instance, such elements may be variously bolted, welded together or equivalents thereof.

While opaque members 151 and 153 of interior support structure 150 and the display portion 50 of electronic display device 160 essentially fill three of the planar compartments defined by exemplary frame member 56 of FIG. 4, a pair of planar members 180 and 182 may be used to fill the remaining compartments thereof. While various materials and configurations may be practiced, it is preferred that planar members 180 and 182 comprise partially translucent or transparent planar members (for example, made of plastic materials), with fixed merchandising indicia illustrated thereon. In such case, the fixed indicia planar members are disposed within compartments defined by frame member 56 such that their fixed indicia faces the frontal surface thereof intended to be viewed by potential customers, analogous to the disposition of display 50 of display device 160. As may be observed from the exemplary illustration of FIG. 4, frame member 56 provides suitable flanges 184 for capture of such fixed indicia planar members.

In addition to such planar elements and members disposed in the planar face of frame member 56, a remote input jack 168 and cover 170 therefor may again be provided in the face of one of the opaque members or the like. As illustrated, extension line 166 associated with such extension input jack connects jack 168 with the jack otherwise mounted on the backside of display device 160.

It is a further general requirement of display device 160 that a transformer 190 be provided to generate the proper voltage for operation thereof. The electrical connection between such transformer and the display device 160 is not illustrated, but is well understood by one of ordinary skill in the art. Various mounting configurations for such transformer may be utilized, but one example thereof is illustrated, wherein screws 192, also used for engaging internal support structure 150 with display device 160, are used for securing transformer 190 to the back side of internal support structure 150. Alternate configurations may of course be practiced without departing from the spirit and scope of the present invention. In any instance, a power input line 194 is connected to transformer 190 so as to initially provide input power thereto.

As understood from FIG. 3, a fluorescent tube 172 may be disposed substantially along the entire horizontal length of advertising means 100 so as to provide backlighting for both fixed indicia of planar members 180 and 182. A pair of mounting brackets 173 (only one illustrated) may be provided within the interior of housing 102. While fluorescent tube 172 is mounted inside, the back, outside of housing member 102 may be used for support of ballast 120 therefor. Ballast 120 again includes an input power line 122 associated therewith.

A plurality of bolts, screws, rivets or the like 196 may be used for securing housing member 102 with frame member 56, as generally discussed above with reference to FIG. 2.

While a number of specific features have been disclosed for a particular exemplary embodiment of the present invention, those of ordinary skill in the art will understand numerous modifications and variations which may be made of such features without departing from the spirit and scope of the present invention. For example, the thickness and depth of either the frame member 56 or housing member 102 may be varied as desired, so long as minimum support criteria apparent to those of ordinary skill in the art are met. Also, various horizontal lengths of advertising means 100 may be used with different size merchandising display units. In each instance, particular features of the invention may be adapted for given circumstances. For example, the length of fluorescent tube 172 may be varied for 52 or 78 inch embodiments of this invention, or a plurality of incandescent bulbs may be utilized instead, as discussed above.

Also, different electronic message display units may be used which have different numbers or sizes of characters, different memories or the like, without limitation to the present invention, which generally combines such moving message displays integrally with merchandising display units or the like. Also, different colors of the moving message display may generally be practiced without limitation, since all moving messages basically have the inherent advantage of actively engaging a potential customer's attention.

Furthermore, various placements and orientations of advertising means 100 may be practiced in accordance with this invention. For example, advertising means 100 may be moved downward from the eye-level (or above) position of FIG. 1 to about middle of cooler 10. In such instance, the two doors 28 and 30 may be horizontally divided into four doors and the interior space 14 separated therealong such dividing line so as to accommodate advertising means 100. A pair of left and right doors would then be disposed above and beneath advertising means 100, respectively. Alternatively, advertising means 100 could be vertically (or even diagonally) oriented on viewing side 32 of cooler 10, instead of horizontally disposed, and with the moving message display device suitably provided and controlled for vertical (or diagonal) operation. In either embodiment, a greatly compressed and highly attractive moving message may be thusly integrally associated with a merchandising display case.

Furthermore, while specific words of description have been used above in describing the presently preferred embodiment, all such language is intended merely as words of description and example, and not words of limitation which appear only in the following claims.

What is claimed:

1. A refrigerated container for merchandising refrigerated products contained therein, comprising:

a generally refrigerated receptacle, having a plurality of insulated walls integrally formed so as to define an interior space and an opening leading thereto;

compartment areas defined within said interior space for supporting within said receptacle products to be refrigerated and merchandised;

at least one door closure member mounted on said receptacle for being selectively positioned so as to alternately open and close said receptacle opening; and advertising means, mounted on said receptacle so as to appear generally flush and integral therewith, for prominently displaying advertising indicia making reference to products supported within said compartment areas, said advertising means including moving message display means for providing a merchandising message related to said products, which message is movable across the face of said display means; wherein said receptacle defines a generally horizontally-oriented cavity, generally above said opening thereof and occupying a prominent position thereon, adapted for receipt of said advertising means; and said advertising means includes a framework member, received generally across the face of said receptacle cavity, for supporting said moving message display means within said generally horizontally-oriented cavity and substantially flush with one of the walls of said receptacle, a pair of generally translucent fixed brand name indicia plates, supported on said framework member and bearing fixed indicia related to the brand names of products received with said compartment areas, a generally horizontally-oriented housing member, secured to said framework member and matingly received within said cavity of said refrigerated receptacle, for generally enclosing the backside of said moving message display means and said brand name indicia plates, and light means, generally received within said housing member, for backlighting said translucent brand name indicia plates.

2. A refrigerated container as in claim 1, wherein:

said moving message display means comprises an electronic, programmable device having an input jack adapted to receive input from a detachable keyboard by which the moving message thereof may be determined to selectively include any desired combination of characters, letters, and numbers illustrated in a repeating sequence; and said advertising means further includes fixed brand name indicia means for providing fixed display of at least one brand name related to products received within said compartment areas.

3. A refrigerated container as in claim 1, wherein:

said framework member further supports opaque members in a plane with said fixed indicia plates and a front face of said moving message display means; and said moving message display means comprises an electronic, programmable device having an input jack adapted to receive an input for selectively determining the moving message thereof; further wherein said opaque members are adapted to support an extension of said input jack on an outward face of said opaque members with a hinged cover thereover, whereby said moving message may be readily changed by an authorized person for presentation of desired merchandising messages without requiring any disassembly of said refrigerated receptacle or said advertising means.

4. A refrigerated container as in claim 1, wherein:

said advertising means comprises an integral unit adapted to be inserted into said receptacle cavity, with a single power input thereto for providing power to both said light means and said moving message display means; and wherein said framework and housing members also support a ballast and transformer associated with said light means and moving message display means, respectively.

5. A refrigerated container as in claim 1, wherein said housing member defines at least one heat dissipation opening therein for venting heat generated by said light means and said moving message display means, whereby said receptacle cavity, said housing member and said opening thereof cooperate to dissipate heat from said advertising means without affecting refrigeration within said refrigerated container interior space.

6. A refrigerated container as in claim 3, wherein:

said door closure member includes at least two pivotable doors supported on hinges mounted adjacent said receptacle opening;

said light means includes a fluorescent tube mounted lengthwise in said housing member substantially along the full length thereof, said tube being positioned so as to backlight both of said pair of fixed indicia plates; and said input jack of said moving message display means is adapted to receive message information input from a detachable keyboard, selected strokes on said keyboard representing a desired merchandising message which is stored and subsequently scrolled by said moving message display means across a front display face thereof.

7. A refrigerated box for merchandising refrigerated products such as drinks identified with particular brand names, comprising:

a generally rectangular, upright refrigerated structure having insulated walls and an interior refrigerated compartment which is adapted for receipt and storage of units of said products, said refrigerated structure defining an opening on one side thereof through which said products may be retrieved;

a door closure member mounted so as to be selectively opened and closed relative said opening to permit said products to be retrieved, said door member being transparent to permit viewing of said products prior to their retrieval;

a generally horizontal and rectangular cavity defined by said refrigerated structure adjacent said one side thereof, and prominently located above said structure opening across the upper top of said refrigerated structure;

indicia support means, received in said cavity, and including a multi-compartment generally planar frame member disposed substantially flush with said one side of said refrigerated structure; and separate fixed and movable advertising indicia respectively associated with different compartments of said frame member;

whereby fixed and movable advertising indicia, directed to products which may be retrieved from within said refrigerated structure, are integrally associated with such refrigerated structure in an attractive manner which enhances the merchandising of the products therein.

8. A refrigerated box as in claim 7, wherein:

said fixed indicia include translucent plastic members generally bearing brand name information specifically directed to products within said refrigerated structure; and said movable indicia includes a moving light display of an electronic, programmable device having an input adapted to be associated with a detachable keyboard for inputting more general merchandising directed to said products for being shown by said light display device.

9. A refrigerated box as in claim 8, wherein:

said moving light display device can illustrate up to fifteen two-inch-high characters at one time; and said indicia support means further includes illumination means for projecting light forward of said refrigerated structure from behind said fixed indicia members, whereby such members are backlighted for attractive and enhanced display of their fixed indicia.

10. Combined fixed and moving merchandising indicia for a merchandising display unit displaying products intended for sale, such unit having a cavity integral with the body thereof, proximate to an opening through which products may be retrieved therefrom, and occupying a prominent position on a side of the display unit which is primarily intended to be viewed by potential purchasers of the products displayed thereby, said indicia comprising:

a housing adapted to be substantially matingly received within such display unit cavity;

a facial frame secured to said housing, substantially situated co-planar with the side of such display unit to be viewed, and defining several compartments in such plane;

a pair of at least partially transparent members, bearing fixed advertising indicia, received respectively in compartments of said facial frame, said fixed indicia thereof being disposed for reading by potential purchasers from the viewing side of such display unit;

an electronic programmable display device, situated in a substantially prominent compartment of said facial frame, for displaying moving advertising indicia; and illumination means supported by said housing behind said fixed indicia members for backlighting same;

whereby both fixed-type and moving message-type advertising indicia may be attractively displayed with an integral appearance relative a merchandising display unit and proximate to the products to which the messages of such indicia are directed, so as to thereby enhance the merchandising of such products.

11. Merchandising indicia as in claim 10, further comprising:

opaque members mounted in some compartments of said facial frame; and an input jack, mounted on one of said opaque members, adapted for being connected to a detachable keyboard whereby said electronic display device may be programmed.

12. Merchandising indicia as in claim 11, further comprising a removable cover associated with said input jack for selectively providing access to reprogramming of said electronic display device.

13. Merchandising indicia as in claim 10, wherein said prominent compartment is disposed generally horizontal on said facial frame, and said electronic display device scrolls messages across the face thereof within the confines of such horizontal compartment.

* * * * *